United States Patent [19]

Matsumaru

[11] Patent Number: 4,503,294

[45] Date of Patent: Mar. 5, 1985

[54] KEYBOARD SWITCH

[75] Inventor: Akihiko Matsumaru, Ibaraki, Japan

[73] Assignee: Nippon Mektron Ltd., Japan

[21] Appl. No.: 555,820

[22] Filed: Nov. 28, 1983

[30] Foreign Application Priority Data

Dec. 30, 1982 [JP] Japan ..... 57-232894

[51] Int. Cl.[3] ..... H01H 13/70

[52] U.S. Cl. ..... 200/5 A; 200/159 B

[58] Field of Search ..... 200/5 A, 8 LR, 159 A, 200/159 B, 275, 302.2, 302.1, 308, 317, 292

[56] References Cited

U.S. PATENT DOCUMENTS

| | | | |
|---|---|---|---|
| 3,627,935 | 12/1971 | Spievak | 200/5 A X |
| 3,777,082 | 12/1973 | Hatley et al. | 200/5 A |
| 3,800,104 | 3/1974 | Lien et al. | 200/5 A |
| 4,029,916 | 6/1977 | Chu | 200/5 A |
| 4,032,729 | 6/1977 | Koistinen | 200/5 A |
| 4,084,071 | 4/1978 | Smith | 200/5 A |
| 4,245,138 | 1/1981 | Harper | 200/5 A |
| 4,400,595 | 8/1983 | Ahumada | 200/5 A |

*Primary Examiner*—J. R. Scott

*Attorney, Agent, or Firm*—Fishman & Dionne

[57] ABSTRACT

A membrane keyboard is presented wherein a series of slits are provided through the switch sheet and disposed above the switch motion cavity whereby the required actuating forces are decreased for switch operational areas of small size relative to those switch operational areas of larger size.

8 Claims, 5 Drawing Figures

KEYBOARD SWITCH

BACKGROUND OF THE INVENTION

This invention relates to the field of electrical keyboards. More particularly, this invention relates to the field of membrane keyboards wherein a stable operational pressure or actuation force may be achieved regardless of the size of the switch operational area.

Membrane keyboards of the general type with which this invention is concerned are well known in the art. These keyboards conventionally have a pair of circuit layers, one fixed and one movable, separated by a spacer or separator layer. The circuit layers are sheets of insulating material, with circuit patterns thereon. These circuit patterns face each other and are separated by a spacer, which has apertures at the location of aligned contact elements on the fixed and movable circuit sheets. Electrical switching is effected by applying finger or other pressure to specific locations on one of the circuit sheets to move a contact on that circuit sheet through an aperture to make contact with a contact element on the other circuit sheet. The fixed and movable circuit layers and the spacer may be separate sheets of material, or any two or three of those sheets may be formed from a single sheet of material folded over in any desired fashion. Keyboards of this configuration are generally formed in a laminate construction with the layers bonded together, sealed or otherwise fixed against relative lateral movement between the layers. The assembly may also include an overlay sheet with indicia of one kind or another to identify key locations and a backer plate to support the assembly.

Membrane keyboard switches as hereinabove described are generally provided with a decorative overlay sheet which is mounted on the first circuit layer or switch sheet to assist the keyboard operator in proper key selection. The size of each particular switch operational area will often differ from key to key as will the corresponding switch motion cavities underneath each key. Thus, larger key areas have larger corresponding switch motion cavities. Unfortunately, larger switch motion cavities need less actuation force or pressure than smaller cavities. This is an undesirable situation for the keyboard operator because of the great disparity in operational pressure from key to key and the relatively large forces needed to actuate small key areas.

SUMMARY OF THE INVENTION

The above discussed and other problems of the prior art are overcome or alleviated by the membrane keyboard of the present invention. In accordance with the present invention, a novel keyboard switch is presented wherein the flexible switch sheet or circuit layer is provided with a series of slits disposed beneath the overlay sheet in small operational areas whereby the actuating force is greatly reduced relative to the prior art. The size and effect of the slits may be varied to achieve a desired operational pressure commensurate with the operational pressure of the larger operational areas. The resultant keyboard has improved operability features for the keyboard operator.

The above discussed and other advantages of the present invention will be apparent to and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
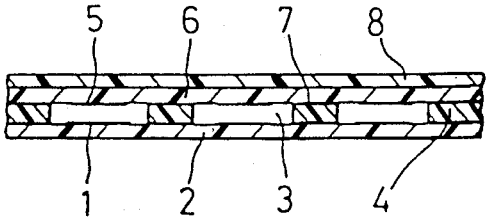
FIG. 1 (PRIOR ART)
FIG. 1 is a cross sectional elevation view of a membrane keyboard in accordance with the prior art.

Referring first to FIG. 1, a conventional panel membrane keyboard in accordance with the prior art is shown. The keyboard switch comprises a first circuit layer 2 and a second circuit layer 6 having circuit patterns 1 and 5 on opposed, i.e., facing surfaces. The circuit patterns 1 and 5 are made up of a plurality of electrically conductive contact points. Circuit layers 2 and 6 are separated therebetween by insulating spacer 4. Spacer 4 is provided with openings or switch cavities 3 which correspond to switch sites or contact points on circuit patterns 1 and 5. Thus, when a force is brought against flexible switch or circuit layer 6, the contact points on circuit pattern 5 are pushed through cavity 3 whereby electrical and mechanical contact is effected with the contact points on circuit pattern 1 defining a switch site. Bonding layer 7 which consists of any suitable adhesive or the like is used to laminate or bond the circuit and separator sheets together.

Figure 2:
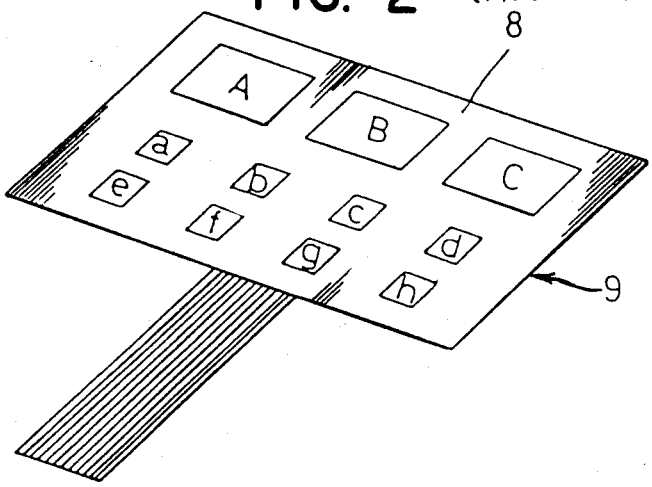
FIG. 2 (PRIOR ART)
FIG. 2 is a perspective view of a keyboard overlay sheet having indicia thereon in accordance with the prior art.

Referring now to both FIGS. 1 and 2, an overlay or display sheet 8 having appropriate indicia thereon is mounted over switch sheet 6 of membrane keyboard 9. The representative indicia permit the keyboard operator to selectively actuate appropriate keys or switch sites. As discussed earlier, larger operational areas such as A, B and C require less operational pressure or actuation force than smaller switch operational regions such as "a" through "h". This is due, of course, to the correspondingly larger switch motion cavities located beneath operational areas A, B and C which provide less support than smaller switch motion cavities beneath regions such as "a" through "h". The difference in required actuation force creates undesirable difficulties for the keyboard operator.

Figure 3:
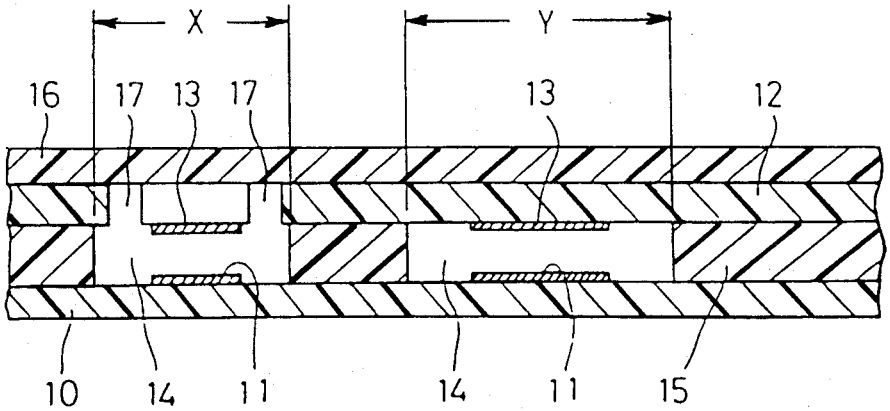
FIG. 3 is a cross sectional elevational view of a membrane keyboard in accordance with the present invention.

As shown in FIG. 3, the keyboard switch of the present invention overcomes this problem by the introduction of slits around the switch operation area which greatly reduces the forces needed for actuation. In FIG. 3, a representative keyboard of the present invention has an operation area Y corresponding in size to, for example, A, B or C in FIG. 2 and an operational area X corresponding in size to, for example, "a" through "h" in FIG. 2.

Except for the novel slit of operational area X, the present invention has a construction similar to that of FIG. 1. Thus, the keyboard of the present invention comprises a lower circuit layer 10 having a circuit pattern 11 of contact points thereon and an upper circuit layer or switch sheet 12 having a circuit pattern 13 of contact points thereon corresponding to and disposed above the contact points of circuit layer 11. An insulating spacer 15 having a plurality of openings or switch motion cavities 14 is adhesively bonded between lower circuit layer 10 and switch sheet 12. An overlay or cover sheet 16 having appropriate indicia thereon for selectively actuating desired key areas X and Y is attached to the upper surface of switch sheet 12.

As mentioned, the larger operational area Y heretofore required less pressure for activating the switch than a key having smaller dimensions such as area X. The present invention overcomes this problem by providing slits 17 in the area above the switch motion cavity. Slits 17 act to considerably lessen the amount of structural support of the operational area. Accordingly, the actuation pressure in a smaller key area can be made equal to that of a large key area providing improved operational feed to the keyboard operation.

Figure 4:
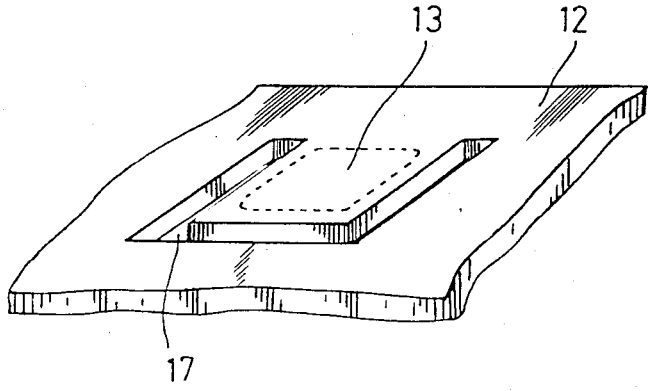
FIG. 4 is a partial perspective view of the keyboard of FIG. 3.

In FIG. 4, a perspective view of the switch sheet 12 of the present invention is shown. Slit 17 is situated in the operational portion of a particular key site and partly surrounds contact point pattern 13. The slit is shown as three perpendicular slots defining a U-shape. Of course, any slit configuration capable of providing the desired degree of actuating force is encompassed by the present invention. For example, other possible configurations include, but are not limited to the slits 17, 17A and 17B of FIG. 5.

Figure 5:
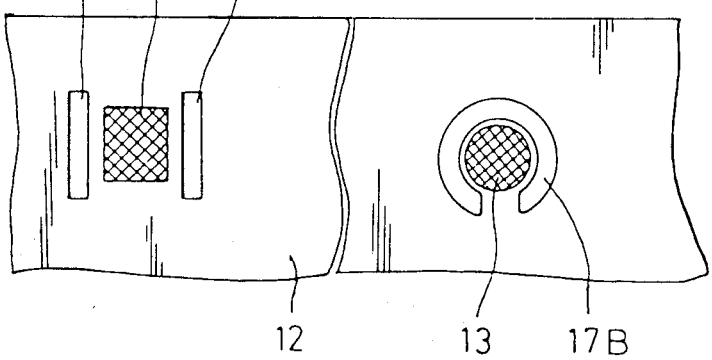
FIG. 5 is a plan view of another embodiment, similar to FIG. 3, in accordance with the present invention.

In FIG. 5, the slits surrounding the rectangular contact point pattern 13 are two opposing slots located on either side of the rectangular circuit pattern 13. An incomplete annular slit 17B having a small portion attached to the switch sheet 12 and surrounding a circular contact point pattern 13 is also shown in FIG. 5. Thus, it will be understood to those skilled in the art that operational pressure or actuation force of a particular membrane keyboard can be varied according to the particular needs and configurations of the cover sheet (with indicia thereon) by modifying the shape, size and/or location of the slits of the present invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A membrane keyboard including:

first electrical circuit means having a plurality of first switch contacts;

second electrical circuit means having a plurality of second switch contacts, and defining a switch sheet;

insulating spacer means between said first and second electrical circuit means, said spacer means having a plurality of openings at locations corresponding to the locations of said first and second switch contacts, said openings defining switch motion cavities and wherein said switch motion cavities define switch operational areas of varying size wherein at least one of said switch operational areas is smaller than said other of said switch operational areas; and at least one slit through said switch sheet disposed above at least one of said switch motion cavities which defines said smaller switch operational area wherein the force for actuating said smaller switch operational area is reduced.

2. A membrane keyboard as in claim 1 wherein said first electrical circuit means includes:

a layer of insulating material with electrically conductive means on one surface thereof facing said second electrical circuit means.

3. A membrane keyboard as in claim 2 wherein said second electrical circuit means includes:

a layer of flexible insulating material with electrically conductive means on one surface thereof facing said first electrical circuit means.

4. A membrane keyboard as in claim 1 including:

cover sheet means attached to said switch sheet, said cover sheet means having indicia thereon disposed above a switch motion cavity for selectively actuating a switch.

5. A membrane keyboard as in claim 1 wherein said slit is comprised of slots having a U-shape.

6. A membrane keyboard as in claim 1 wherein said slit is comprised of two opposing slots on each side of said switch contacts.

7. A membrane keyboard as in claim 1 wherein said slit is comprised of an incomplete annular slot surrounding said first switch contacts.

8. A membrane keyboard as in claim 1 wherein:

said switch motion cavities define separate and discreet switch operational areas.

* * * * *